US010377395B2

(12) United States Patent
Maki

(10) Patent No.: US 10,377,395 B2
(45) Date of Patent: Aug. 13, 2019

(54) UNCOUPLING LEVER FOR RAIL CAR WITH BIASING MEMBER

(71) Applicant: Ireco, LLC, Elmhurst, IL (US)

(72) Inventor: Brian Maki, Wood Dale, IL (US)

(73) Assignee: IRECO, LLC, Elmhurst, IL (US)

( * ) Notice: Subject to any disclaimer, the term of this patent is extended or adjusted under 35 U.S.C. 154(b) by 349 days.

(21) Appl. No.: 15/475,372

(22) Filed: Mar. 31, 2017

(65) Prior Publication Data

US 2018/0281827 A1 Oct. 4, 2018

(51) Int. Cl.
*B61G 7/02* (2006.01)

(52) U.S. Cl.
CPC ..... *B61G 7/02* (2013.01)

(58) Field of Classification Search
CPC ..... B61G 7/02
USPC ..... 213/162
See application file for complete search history.

(56) References Cited

U.S. PATENT DOCUMENTS

| | | | | | |
|---|---|---|---|---|---|
| 2,281,938 | A | | 5/1942 | Klaucke | |
| 3,933,252 | A | * | 1/1976 | Murphy | B61G 3/08 213/166 |
| 4,010,854 | A | | 3/1977 | Manyek | |
| 4,378,890 | A | | 4/1983 | Empson | |
| 4,454,953 | A | * | 6/1984 | Chierici | B61G 1/04 213/162 |
| 4,460,099 | A | * | 7/1984 | Empson | B61G 3/08 213/159 |
| 4,544,072 | A | * | 10/1985 | Randolph | B61G 3/08 213/166 |
| 4,602,717 | A | * | 7/1986 | Krzanowsky | B61G 7/02 213/162 |
| 5,129,529 | A | * | 7/1992 | Manyek | B61G 7/02 213/159 |
| 6,739,464 | B1 | | 5/2004 | Manyek | |
| 7,686,177 | B1 | * | 3/2010 | Jackson | B61G 7/02 213/159 |
| 7,900,786 | B2 | * | 3/2011 | Hepburn | B61G 7/02 213/159 |
| 8,434,802 | B2 | * | 5/2013 | Lofley, Sr. | B25G 1/04 294/175 |
| 8,469,426 | B2 | | 6/2013 | Lofley, Sr. et al. | |
| 8,671,807 | B2 | | 3/2014 | Monroe | |
| 10,017,194 | B1 | * | 7/2018 | Jackson | B61G 7/02 |
| 2018/0281827 | A1 | * | 10/2018 | Maki | B61G 7/02 |

* cited by examiner

*Primary Examiner* — Jason C Smith
(74) *Attorney, Agent, or Firm* — Thompson Coburn LLP

(57) ABSTRACT

An uncoupling lever for a railcar has first, second, and third lever members slidably connected to each other for relative motion along their lengths. The second and third lever members are urged apart from one another along their lengths with a biasing member. The uncoupling lever has a handle configured for manual operation of the uncoupling lever, and a hook configured for actuating a lock of a coupler of the railcar. One of the handle and hook is operatively connected to the first lever member and the other of the handle and hook is operatively connected to the third lever member.

27 Claims, 11 Drawing Sheets

UNCOUPLING LEVER FOR RAIL CAR WITH BIASING MEMBER

BACKGROUND

This disclosure relates to an uncoupling lever for a railcar. The uncoupling lever attaches to an end of a railcar and is used to uncouple adjacent railcars. The uncoupling lever has a handle which is rotated upward to move the uncoupling lever upward, which then raises a lock lifter linkage and allows a knuckle of the coupler of the railcar to open, thereby uncoupling the adjacent railcars. In particular, this disclosure relates to a telescoping type of lever with a biasing member that allows for improved extension and compression of the uncoupling lever and overall improved operation.

A telescoping uncoupling lever, such as that disclosed herein, is typically used on railcars that have large coupler longitudinal and angular movements such that there is a highly variable distance from the attachment point of the uncoupling lever at a clevis of the railcar to the lock lifter linkage on the knuckle of the coupler of the railcar. The range in distance between these points may be between 32" and 68", or between 38" and 84", depending on the railcar. These types of railcars typically require the shock absorbing capabilities that a coupler with the long travel provides. This is generally known as "end of car cushioning". The uncoupling lever disclosed herein may be used in such an application.

SUMMARY

As described in more detail below, the exemplary uncoupling lever includes first, second and third lever members with a biasing member disposed between the second and third lever members to improve the manner in which the first, second, and third lever members cooperate with each other during extension and compression of the uncoupling lever. Without any length constriction applied to the uncoupling lever (i.e., a free state of the uncoupling lever), the second and third lever members may be biased by the biasing member to an extended position of the uncoupling lever. As the railcar coupler moves and the distance between the clevis and the lock lifter decreases, the second and third lever members may remain extended through action of the biasing member, and the second and third lever members may slide as a unit together relative to the first lever member. A stop associated with the first lever member may limit compression of the uncoupling lever. As the coupler continues to move and the distance between the clevis and lock lifter further decreases, the travel of the second and third lever members may be limited by the stop. At this point, the second and third lever members may begin to slide relative to one another against the force of the biasing member to accommodate the decreasing distance between the clevis and lock lifter. In this way, the biasing member controls the manner, and at least to some extent the sequence, of compression of the first, second and third lever members, which may increase the life expectancy of the uncoupling lever.

Extension of the uncoupling lever is the reverse of the above description. As the distance between the clevis and lock lifter increases, the biasing member urges the second and third lever members apart. As the clevis to lock lifter distance further increases, the second and third lever members move as a unit together relative to the first lever member until the uncoupling lever reaches its maximum travel. Preferably, the range of travel of the uncoupling lever exceeds the range of distances between the clevis and lock lifter. In other words, the uncoupling lever is configured to not limit the travel (extended or compressed) of the coupler of the railcar. The railcar coupler travel is typically limited by other features of the railcar (e.g, striker width, cushioning unit/draft gear length, etc.).

As will become evident from the description that follows, the exemplary uncoupling lever reduces the contact of the lever members against each other which in turn reduces the potential for the uncoupling lever to bend or otherwise fail. Also, in the uncoupling lever described herein, there will tend to be smoother travel and less free play or sloppiness in the travel of the lever members thereby also reducing the potential of bending of the uncoupling lever.

DETAILED DESCRIPTION

Figure 1:
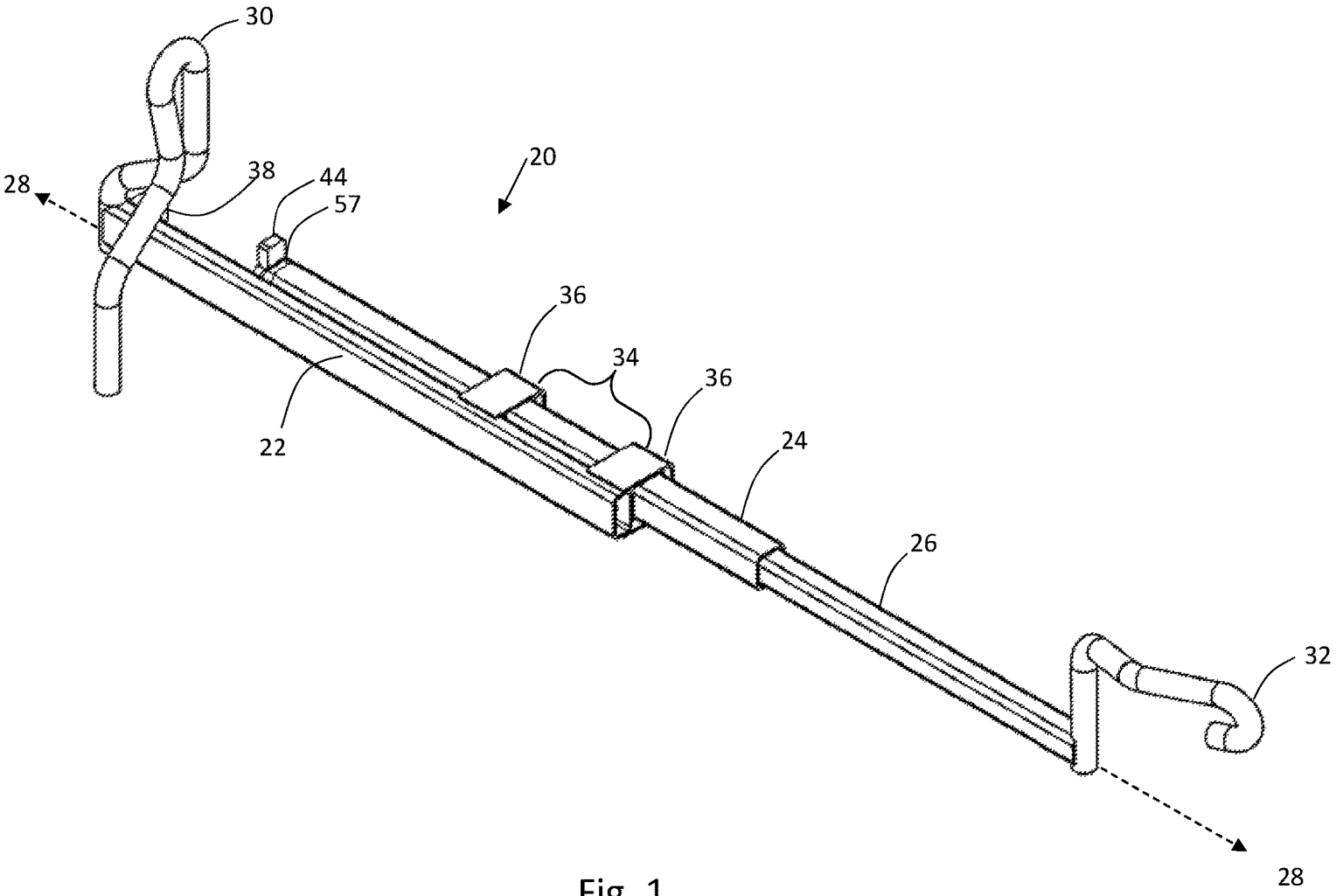
FIG. 1 is a perspective view of the uncoupling lever in an intermediate position of extension and compression.

As shown in the drawing figures, the exemplary uncoupling lever 20 comprises three lever members 22,24,26. The first and second lever members 22,24 are slidably connected to each other for relative motion along their lengths. The second and third lever members 24,26 are also slidably connected to each other for relative motion along their respective lengths. The sliding motion of the levers 22,24,26 along their respective lengths defines a length direction 28. The sliding motion along the length direction 28 may be parallel and may be co-axial depending upon the arrangement and construction of the lever members 22,24,26. The first lever member 22 may have a handle 30 operatively connected to an axial end of the first lever member, and the third lever member 26 may have a hook 32 operatively connected to an axial end of the third lever member. The handle 30 may be operatively connected to the clevis of the railcar to permit pivoting motion of the uncoupling lever about an axis parallel to the length direction of the uncoupling lever. The hook 32 may be operatively connected to the railcar lock lifter linkage. Although the drawings show the handle 30 associated with the first lever member 22 and the hook 32 associated with the third lever member 26, the hook and handle may be reversed.

The first lever member 22 may comprise a bar or tube. Although the drawings show the first lever member 22 as generally a rectangular or square cross-sectional tube, the construction and cross sectional geometry may be any shape. On a portion of the first lever member 22, axially opposite the axial end generally adjacent to the handle 30, the first lever member may be configured to receive the second lever member 24. In the exemplary uncoupling lever 20, the first lever member 22 may have a housing 34 formed on its exterior surface configured to receive the second lever member 24. The housing 34 may be positioned on a side exterior of the first lever member 22 so that the second lever member 24 moves relative to the first lever member parallel along the length direction 28 but offset in a direction transverse to length direction along a width direction of the first lever member. The second lever member 24 and first lever member 22 may also be configured for sliding motion in a co-axially aligned manner. In this configuration, the housing of the first lever member may be concentrically located with the first lever member in the length direction rather than being offset to the side of the first lever member as shown in the drawings.

Figure 2:
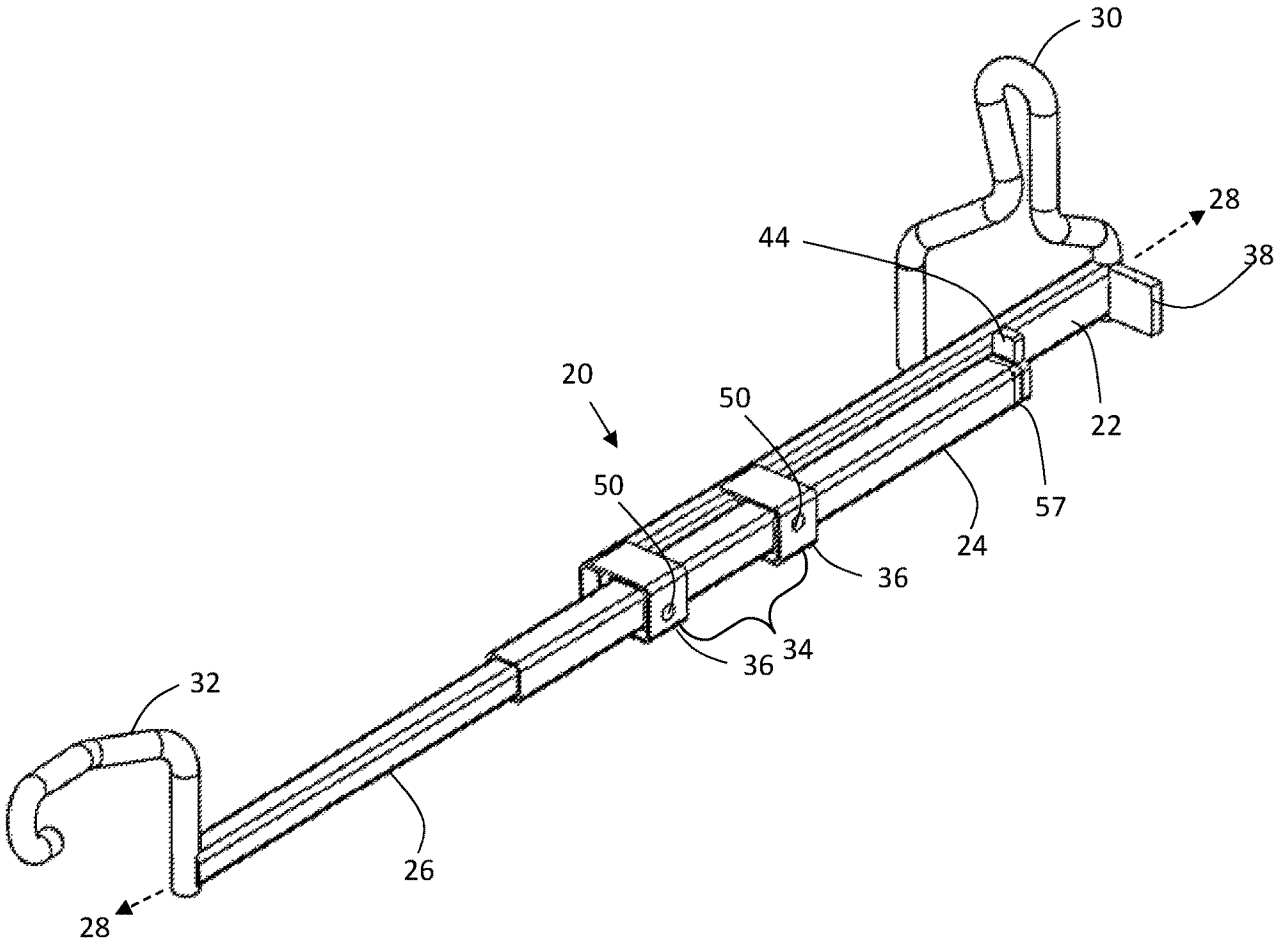
FIG. 2 is an alternate perspective view of the uncoupling lever of FIG. 1.
Figure 3:
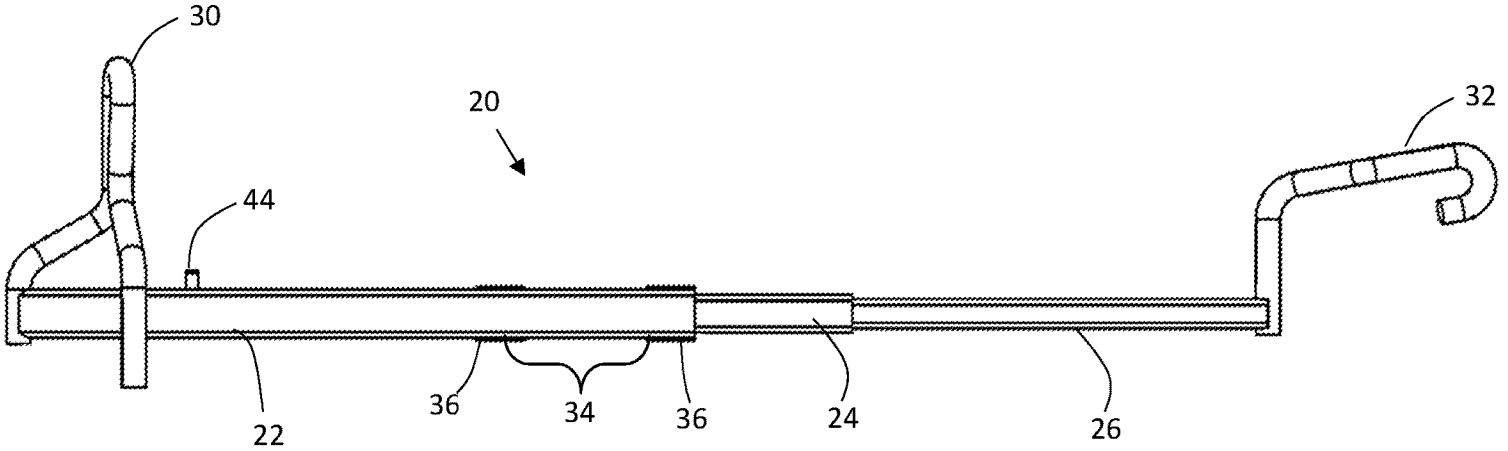
FIG. 3 is a front view of the uncoupling of FIG. 1.
Figure 4:
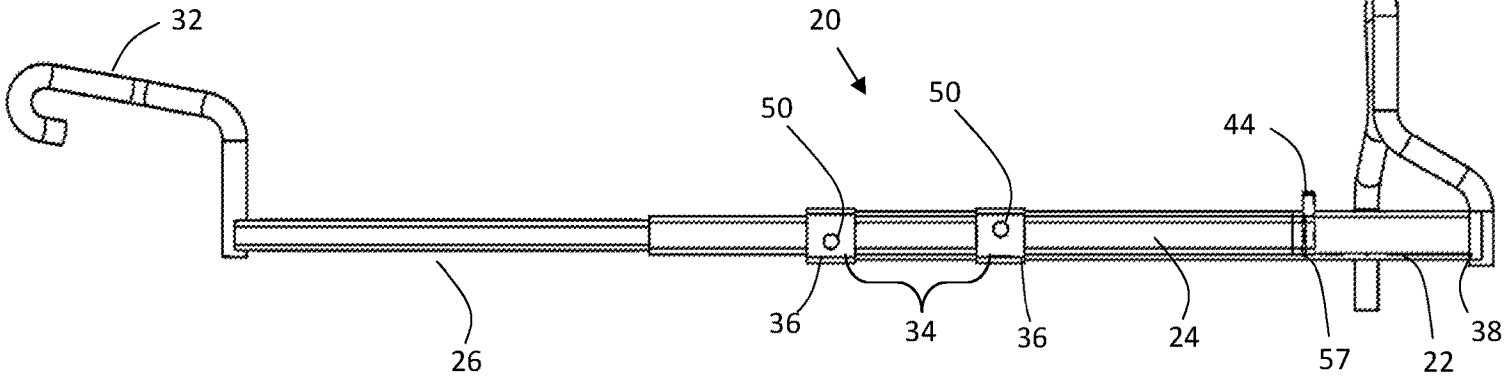
FIG. 4 is a rear view of the uncoupling lever of FIG. 1.

As shown in the drawings, the housing 34 of the first lever member 22 comprises two enclosures 36 spaced apart along a length of the first lever member. One or more enclosures 36 may comprise the housing 34. The enclosures 36 may be disposed on the exterior side surface of the first lever member 22. The enclosures 36 may include guides (FIGS. 2,4, '50') and other bearing surfaces on their interiors to allow smooth sliding motion of the second lever member 24 relative to the housing and first lever member 22. The enclosure 36 may be sized or multiple enclosures spaced apart in the length direction 28 along the first lever member 22 at a distance sufficient to support and maintain the second lever member 24 in alignment with the first lever member during extension and compression of the uncoupling lever 20.

Figure 12:
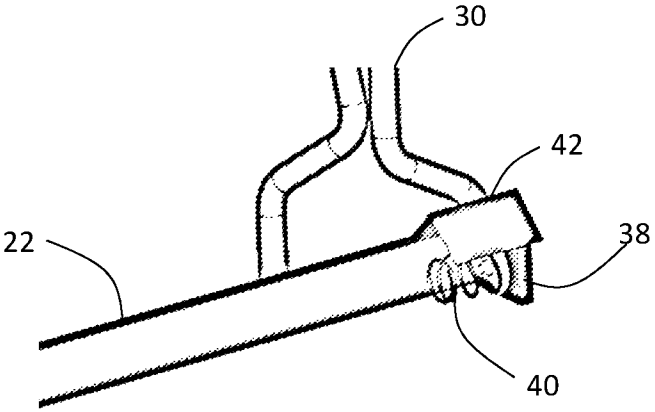
FIG. 12 is a perspective view of an alternate configuration of an axial end of a first lever member of the uncoupling lever of FIG. 1.
Figure 13:
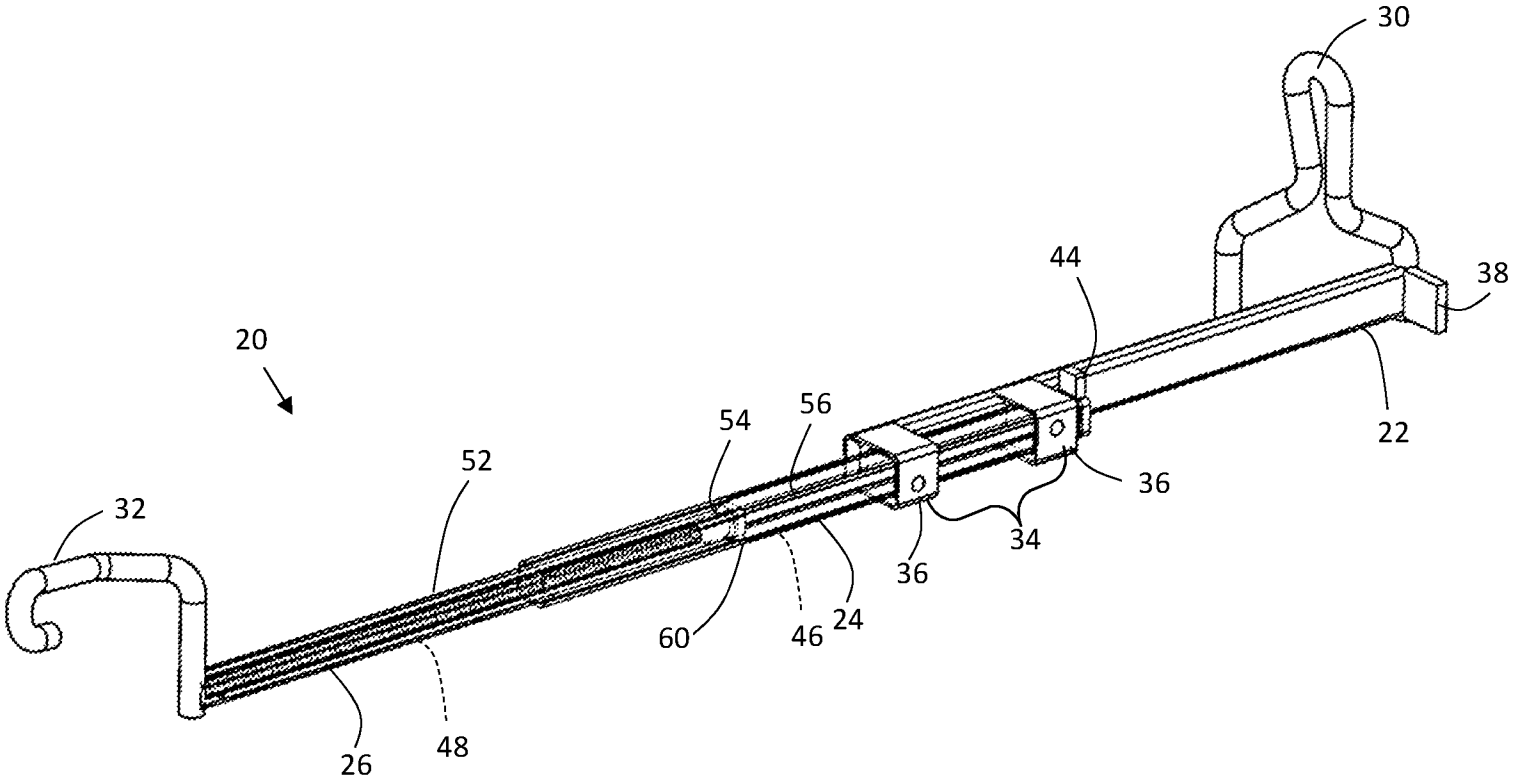
FIG. 13 is a perspective view of the uncoupling lever of FIG. 1 fully extended with the second and third lever members shown in phantom, and the biasing member, the piston and the piston rod in the hollow interiors of the second and third lever members.
Figure 14:
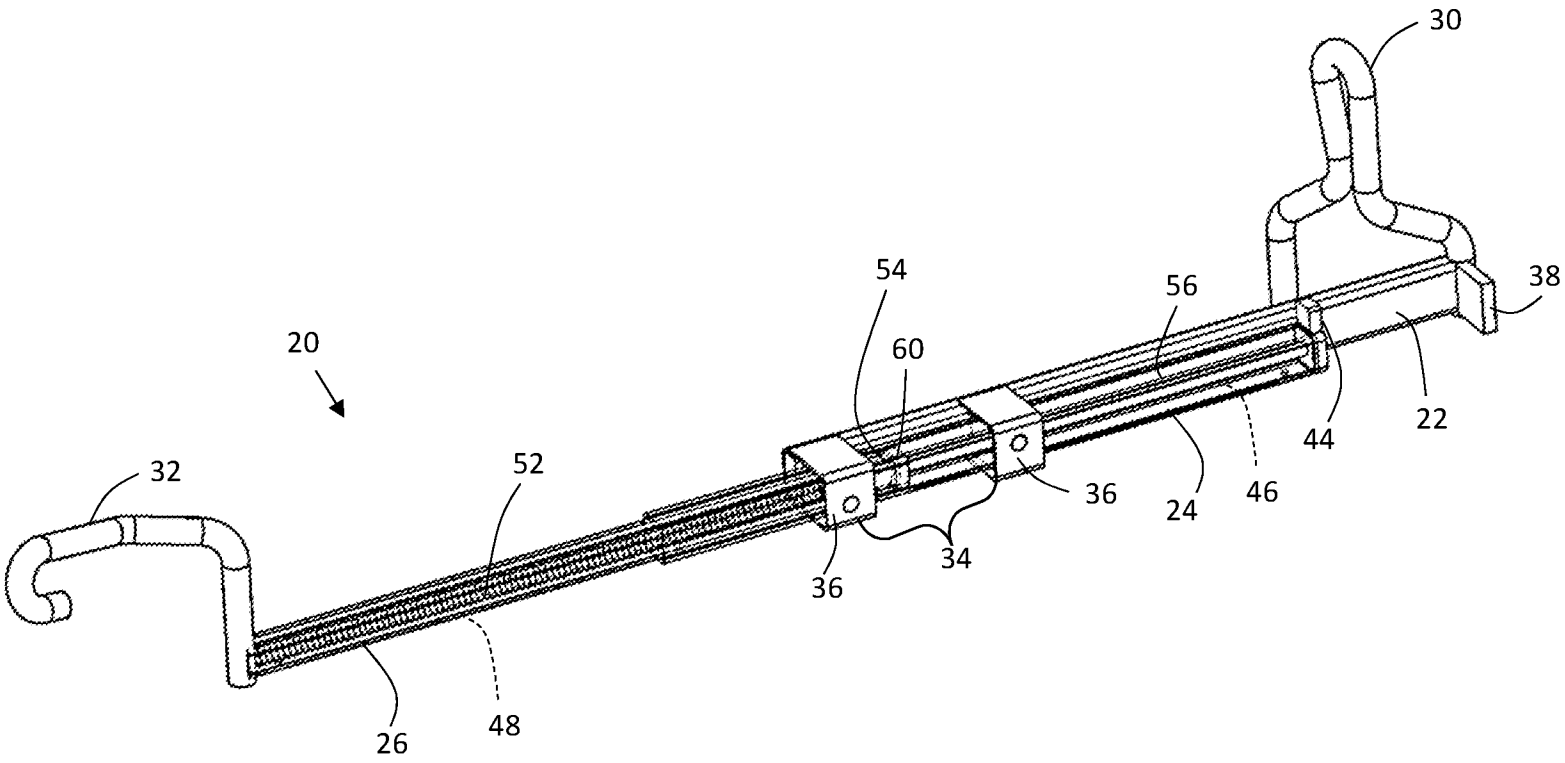
FIG. 14 is a perspective view of the uncoupling lever of FIG. 13 with the second and third member members moving as a unit relative to the first lever member as the uncoupling lever is compressed.
Figure 15:
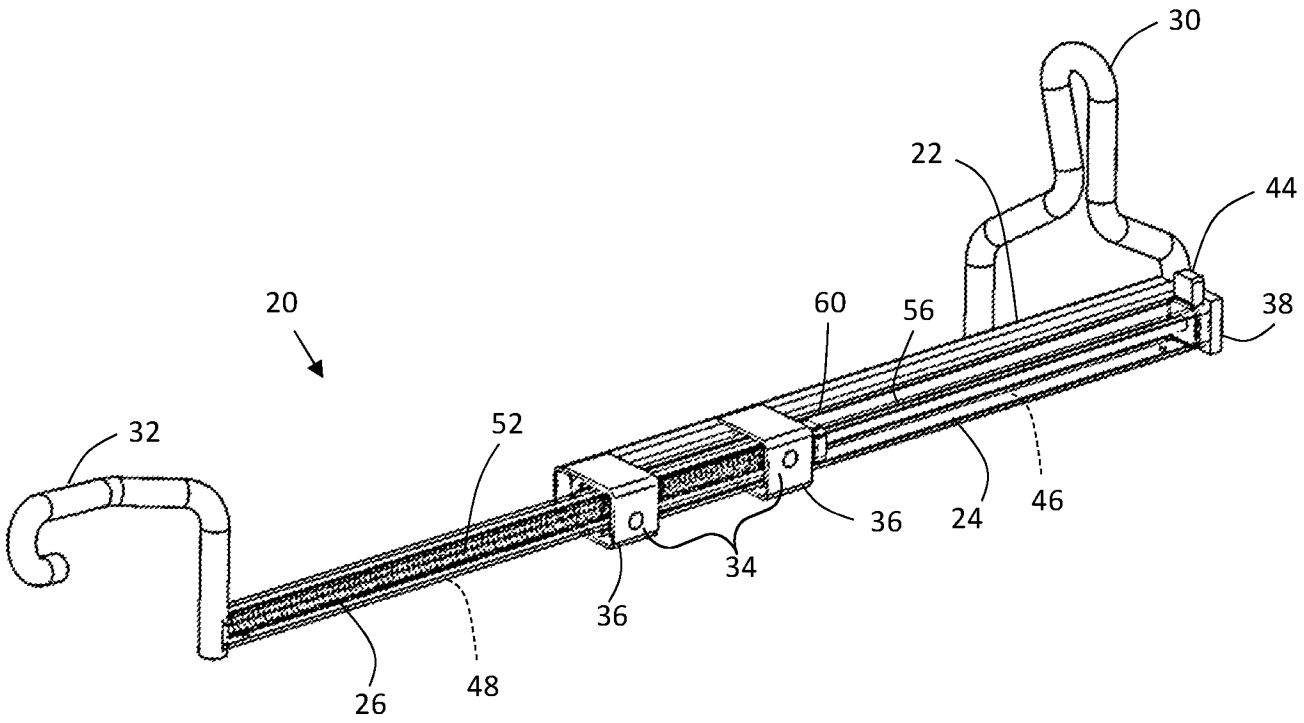
FIG. 15 is a perspective view of the uncoupling lever of FIG. 13 with the second and third lever members reaching the limits of their travel relative to the first lever member as the uncoupling lever continues to be compressed.

On the axial end of the first lever member 22 generally adjacent to the handle 30, a back stop 38 may be provided. The back stop 38 may be configured to engage the second lever member 24 during compression of the uncoupling lever 20 to limit compression of the uncoupling lever. As shown in FIG. 12, the back stop 38 may be configured with a spring 40 to cushion any impact of the second lever member 24 against the back stop 38 during compression of the uncoupling lever. The spring 40 may comprise an elastomer spring, a coil spring, a barrel shaped spring, or a conically shaped spring. A shield 42 may be provided about the spring 40 to limit any potential pinch point and protect the spring from environmental elements.

The second lever member 24 has axially opposite ends about its length. One end of the second lever member may travel between the housing 34 of the first lever member 22 and the back stop 38 of the first lever member. A travel stop 44 may be provided on the second member axial end to engage the first lever member back stop 38 during compression of the uncoupling lever. The travel stop 44 may also engage the first lever member housing 34 during an over-travel extension condition of the uncoupling lever. The opposite axial end of the second lever member 24 may extend from the housing 34 and be configured for sliding motion with the third lever member 26. When fully compressed, the axial end of the second lever member 24 may protrude slightly beyond the housing 34 of the first lever member to prevent any portion of the axial end of the second lever member from becoming raised or deformed over time from interfering with any bearing or smooth sliding surfaces of the interior of the housing. In one embodiment as shown in the drawings, the second lever member 24 may comprise a tube or other structural piece with a hollow interior 46. Although the drawings show the second lever member as having a generally rectangular or square cross-section, the second lever member may have a cross-section of any shape. The hollow interior 46 of second lever member 24 may be configured to receive the third lever member 26 in a telescopically or coaxially aligned arrangement. Although the third lever member 26 is shown in the drawings with its exterior surface sliding within the hollow interior 46 of second lever member 24, the arrangement may be reversed and the exterior surface of the second lever member may slide within an interior of the third lever member.

The third lever member 26 is configured for sliding motion relative to the second lever member 24. An axial end of the third lever member is configured for connection to the hook 32 which engages the lock lifter linkage of the railcar coupler. The hook 32 may be operatively connected to the third lever member 26 in a manner where the hook forms a mechanical stop so as to limit compression of the uncoupling lever. The hook 32 may also extend from the third lever member axial end in seamless manner. The third lever member 26 may comprise a tube that cooperates with the second lever member 24 for sliding motion with an axial end of the third lever member received in the hollow interior 46 of the second lever member as will be described. The third lever member 26 may have a hollow interior 48. Although the drawings show the third lever member 26 as having a rectangular or square shaped cross-sectional geometry, the third lever member may have any shape. If the cross section is round, then the travel stop 44 may be configured to assist in positioning the tubular shapes of the second and third lever members 24,26 within or on one another in order to perform the intended telescopic functioning of the second and third lever members.

To facilitate sliding motion of one or more of the lever members, one or more lever members may have a compressible boot (not shown) extending over its exterior. The boot may shield the exterior surfaces of a lever member from environmental elements. Additionally, the exterior surfaces of the lever members may be provided with indentations or detents (not shown) configured to retain or receive grease or other lubricant thereby enabling the exterior surfaces of the lever members to slide smoothly against each other. Additionally, low friction guides, pins, or other bearing surfaces 50 may be provided on the exterior surfaces of the lever members or any interior surfaces to facilitate smooth sliding motion therebetween, and to limit any free play between the sliding surfaces.

Figure 5:
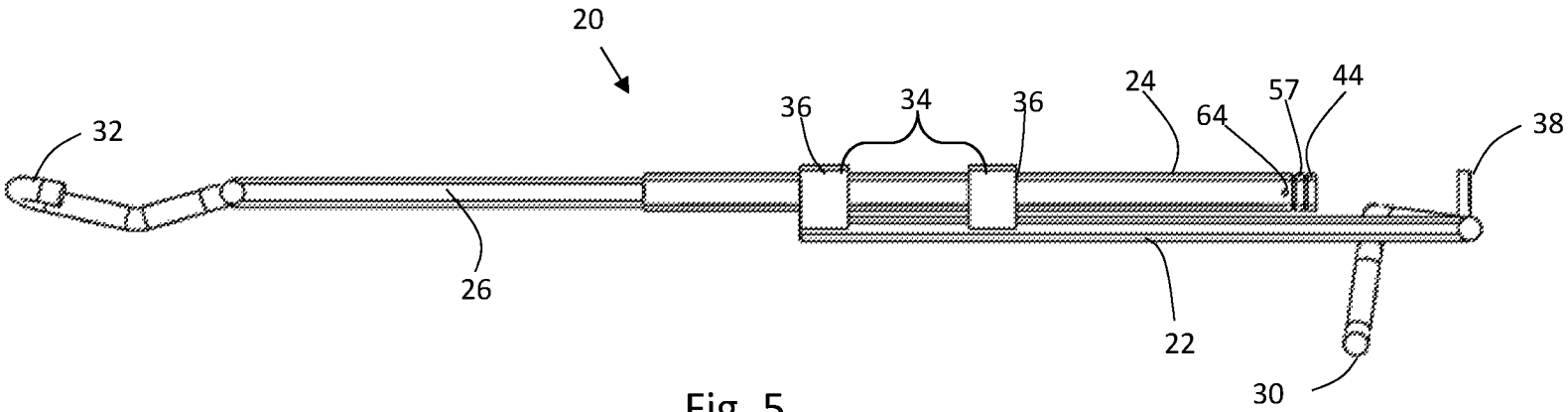
FIG. 5 is a bottom view of the uncoupling letter of FIG. 1.
Figure 6:
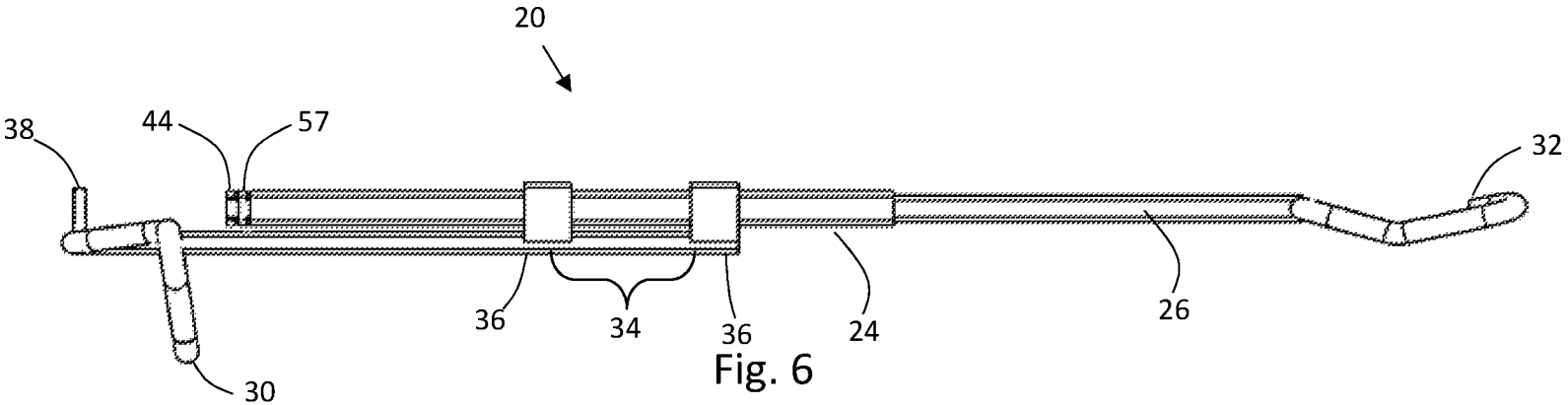
FIG. 6 is a top view of the uncoupling lever of FIG. 1.
Figure 8:
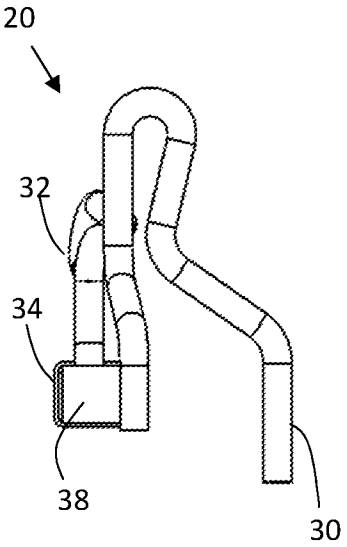
FIG. 8 is a right side view of the uncoupling lever of FIG. 1.
Figure 7:
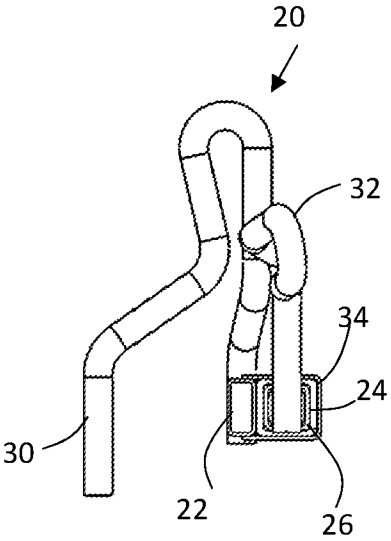
FIG. 7 is a left side view of the uncoupling lever of FIG. 1.
Figure 9:
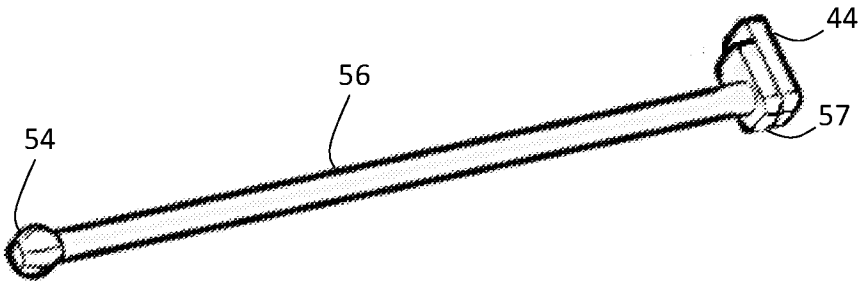
FIG. 9 is a perspective view of a piston and piston rod configured for use with the uncoupling lever of FIG. 1.
Figure 10:
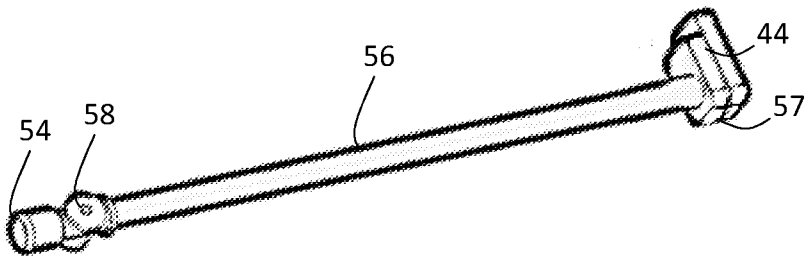
FIG. 10 is an alternate embodiment of the piston rod of FIG. 9.
Figure 11:
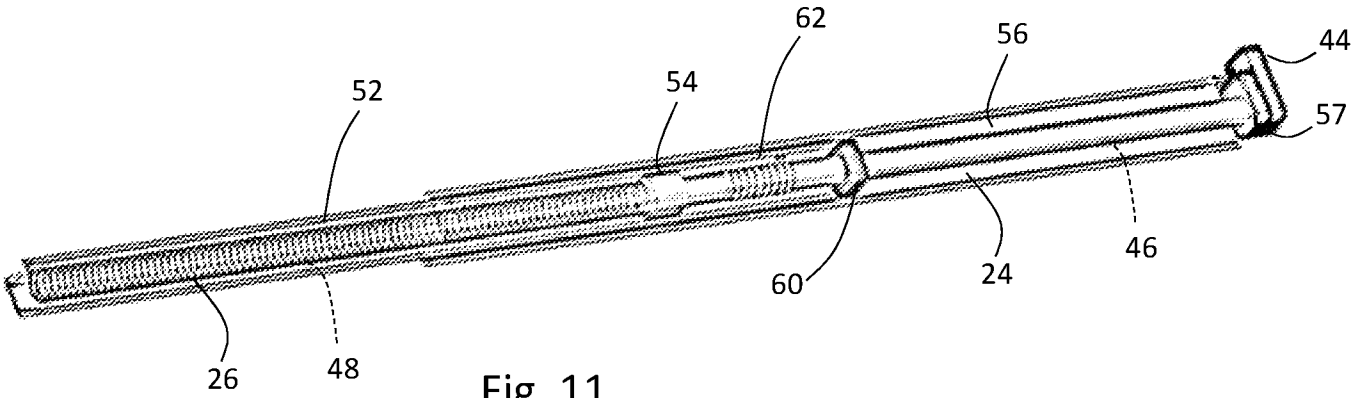
FIG. 11 is a perspective view of the uncoupling lever of FIG. 1 showing second and third lever members of the uncoupling lever in phantom, and a biasing member, piston and piston rod disposed in hollow interiors of the second and third lever members.

FIGS. 9-11 and 13-16 provide additional detail of the cooperation of the second and third lever members 24,26 and the biasing member 52. As shown in the drawings, the third lever member 26 is brought into register within the hollow interior 46 of the second lever member 24, and the biasing member 52 is positioned between a piston 54 and the axial end of the third lever member 26 adjacent to the hook 32. In one embodiment as shown in the drawings, the piston 54 is positioned between the axial ends of the second lever member and supported with a piston rod 56 that extends from an axial end of the second lever member. In an alternate configuration (not shown), the piston or a portion thereof, and/or the piston rod may extend beyond the axial end of the second lever member. Depending upon the position of the piston relative to the axial end of the second lever member, the piston may be disposed in the hollow interior of the third lever member during extension and compression of the second and third lever members over the intended operating range of the coupling lever. The piston rod 56 may be mounted to a backer plate 57 on the axial end of the second lever member 24. The backer plate 57 may seal the hollow interior 46 of the second lever member 24. The backer plate 57 may be welded or otherwise mechanical mounted to the second lever member (e.g., fastener '64', FIG. 5). The travel stop 44 may be removably connected to backer plate 57, for instance, to allow disassembly of the second lever member from the first lever member, as will be described below. The piston rod 56 may be made from a material that is solid or may be formed from a deflectable material such as wire rope to reduce the potential of the piston and/or piston rod from becoming bound within the hollow interiors 46,48 of the second and third lever members 24,26. The piston 54 may have an end shaped to engage the biasing member 52. The edges of the piston 54 may also be shaped in a manner to allow the third lever member 26 to slide over the piston and for the piston to slidably engage and bear against the hollow interior 48 of the third lever member during extension and compression of the coupling lever 20. The piston 54 may be formed integral with the piston rod 56 or may be mechanically attached to the piston rod. As shown in FIG. 10, the piston rod 56 may have rollers 58 rotatably connected to the piston rod to facilitate sliding motion between the third lever member 26 and the second lever member 24. A bushing or bearing assembly (not shown) may be provided between the piston rod and the inner diameter surface of the third lever member. The bearing assembly may be disposed around the piston rod. Such a bearing assembly may or may not include a cap 60 to seal the third lever member 26, as discussed below. Various coatings (e.g., oil, grease, graphite, Teflon™, etc.) may be applied to the sliding surfaces of the lever members to reduce the coefficient of friction.

As shown in the drawings, the biasing member 52 may be disposed in the hollow interior 48 of the third lever member 26. Depending upon the position of the piston and piston rod relative to the axial end of the second lever member, and the position of the third lever member relative to the second lever member, a portion of the biasing member may be disposed within the hollow interior of the second lever member. The biasing member 52 may be configured to urge the third lever member 26 away from the second lever member 24 over the intended operating range of the uncoupling lever. The biasing member 52 may extend from the piston 54 through the hollow interior 48 of the third lever member to the axial end of the third lever member 26 adjacent the hook 32. The biasing member 52 may be a coil spring or elastomer spring. Although the drawings show the biasing member 52 extending through the hollow interior 48 of the third lever member 26 into the hollow interior 46 of the second lever member 24, the biasing member may be arranged exterior to the second lever member and/or the third lever member.

Depending upon the length of the third lever member 26 and/or the position of the piston 54 and piston rod 56 relative to the axial end of the second lever member 24, the axial end of the third lever member may extend into the hollow interior 46 of the second lever member beyond the piston. The cap 60 may be provided on the axial end of the third lever member 26. The cap 60 may seal the hollow interior 48 of the third lever member 26 to protect the biasing member 52 from the elements. Drain holes (not shown) may be provided to allow draining of the hollow interiors 46,48 of the second and third lever members 24,26. The cap 60 of the third lever member 26 may also limit travel of the third lever member relative to the second lever member 24 during extension of the uncoupling lever. In one embodiment, the third lever member cap 60 may engage the piston 54 to limit extension of the third lever member relative to the second lever member. In another embodiment, a second biasing member 62 (FIG. 11) may be disposed between the piston 54 and the cap 60 to reduce any impact between the cap and piston during extension of the uncoupling lever. In the embodiments shown in the drawings with the third lever member 26 disposed within the hollow interior 46 of the second lever member 24, the second biasing member 62 may be within the hollow interior 48 of the third lever member 26 between the cap 60 and the piston 54. In the alternative, the second biasing member may be arranged on the exterior of the second and/or third lever member. The second biasing member 62 may be free floating on the piston rod between the third lever member cap 60 and the piston 54. In the alternative, the second biasing member may be operatively connected to the cap and/or the piston. The second biasing member may comprise a coil spring or an elastomer spring.

Figure 16:
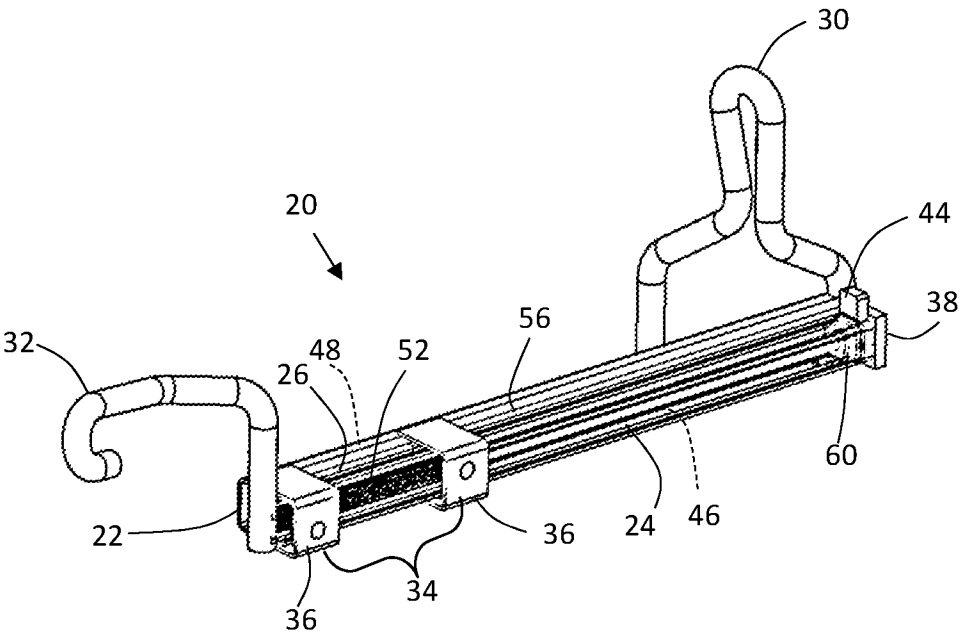
FIG. 16 is a perspective view of the uncoupling lever of FIG. 13 with the second and third lever members compressed together and the uncoupling lever fully compressed.

As mentioned previously, at the normal operating length of the uncoupling lever, the third lever member 26 is urged away from the second lever member 24. During compression, the biasing member 52 has sufficient force to enable the second and third lever members 24,26 to travel as a unit relative to the first lever member 22. Once the travel stop 44 of the second lever member 24 contacts the backstop 38 of the first lever member 22, the force exerted by the biasing member 52 may be overcome thereby enabling the third lever member 26 to slide relative to the second lever member 24 and thereby compressing the biasing member 52 and the uncoupling lever. The compression may continue until as shown in FIG. 16, the biasing member 52 is fully compressed within its intended operating range within the hollow interior 48 of the third lever member 26. As mentioned before, the range of travel of the uncoupling lever exceeds the range of distances between the clevis and lock lifter and features of the railcars themselves would limit the travel of the coupler rather than the uncoupling lever. During extension of the coupling, the reverse may occur. Accordingly, the biasing member 52 may urge the second and third lever members 24,26 apart until a position where the second and third lever members travel as a unit relative to the first lever member 22 to return the uncoupling lever to a fully extended position.

As may be desired, for instance due to maintenance or replacement, the second and third lever members 24,26 may be removed as a unit from the first lever member 22. The travel stop 44 on the axial end of the second lever member 24 may be removed from the backer plate 57 to enable the second lever member to slide axially out of the housing 34 of the first lever member 22. The travel stop 44 may be removably connectable to the backer plate 57 with a mechanical fastener (not shown). In a construction in which the backer plate 57 is removably connected to the second lever member, a fastener 64 (FIG. 5) may be disconnected to disassemble the backer plate from the second lever member. The same or a different mechanical fastener may be disconnected to disassemble the backer plate 57 and/or the second lever member 24 from the piston rod 56. In an alternate construction, the travel stop 44 may comprise a mechanical fastener projecting from the backer plate. To allow the second and third lever members to be disassembled from the first lever member 22, the mechanical fastener forming the travel stop 44 projecting from the backer plate 57 may be removed.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. An uncoupling lever for a railcar comprising:

First, second and third lever members, the first and the second lever members being slidably connected to each other for relative motion therebetween along their lengths, and the second and the third lever members being slidably connected to each other for relative motion therebetween along their lengths, the second and third lever members being urged apart from one another along their lengths with a biasing member; and a handle configured for manual operation of the uncoupling lever; and a hook configured for operating a lock of a coupler of the railcar;

wherein one of the handle and hook is operatively connected to the first lever member and the other of the handle and hook is operatively connected to the third lever member.

2. The uncoupling lever of claim 1 wherein the first and the second lever members are offset in a direction transverse to their lengths.

3. The uncoupling lever of claim 1 wherein the second and the third lever members are coaxially aligned.

4. The uncoupling lever of claim 1 wherein the third lever member is received within a hollow interior of the second lever member.

5. The uncoupling lever of claim 1 wherein the second lever member includes a stop that engages a housing of the first lever during extension of the uncoupling lever to prevent the first lever member from disconnection with the second lever member.

6. The uncoupling lever of claim 1 wherein the first lever member includes a stop that engages the second lever member during compression of the uncoupling lever to limit compression of the uncoupling lever.

7. The uncoupling lever of claim 1 wherein the handle is operatively connected to the first lever member.

8. The uncoupling lever of claim 1 further comprising a piston in the hollow interior of the third lever member configured for engaging the biasing member.

9. The uncoupling lever of claim 8 further comprising a piston rod supporting the piston extending through the hollow interior of the second lever member.

10. The uncoupling lever of claim 1 wherein the biasing member is disposed in a portion of a hollow interior of the second lever member and a portion of a hollow interior of the third lever member.

11. An uncoupling lever for a railcar comprising:

a first lever member having a housing with a hollow interior;

a second lever member having an outer surface configured for sliding motion within the hollow interior of the housing of the first lever member, the second lever member having axially opposite first and second ends with the first axial end being extendable from the first lever member housing away from the first lever member;

a third lever member being telescopically arranged with the second lever member at the second lever member first axial end with the biasing member urging the third lever member away from the second lever member;

a handle configured for manual operation of the lever; and a hook configured for operating a lock of the coupler of the railcar;

wherein one of the handle and hook is operatively connected to the first lever member and the other of the handle and hook is operatively connected to the third lever member.

12. The uncoupling lever of claim 11 wherein the hook is operatively connected to the third lever member.

13. The uncoupling lever of claim 11 wherein the second and third lever members each have a hollow interior.

14. The uncoupling lever of claim 13 wherein the biasing member extends through portions of the hollow interiors of the second and third lever members.

15. The uncoupling lever of claim 14 further comprising a piston in the hollow interior of the third lever member configured to engage the biasing member.

16. The uncoupling lever of claim 15 further comprising a piston rod extending through the second lever member hollow interior supporting the piston.

17. The uncoupling lever of claim 16 wherein the piston rod extends from the second axial end of the second lever member.

18. The uncoupling lever of claim 15 wherein the third lever member has an axial end with a cap.

19. The uncoupling lever of claim 18 further comprising a second biasing member disposed in the third lever member hollow interior between the third lever member cap and the piston.

20. The uncoupling lever of claim 13 wherein the third lever member is received within the hollow interior of the second lever member through the first axial end of the second lever member.

21. The uncoupling lever of claim 11 wherein the biasing member comprises a coil spring.

22. The uncoupling lever of claim 11 wherein the second lever member second axial end comprises a travel stop configured to limit extension of the second lever member relative to the first lever member.

23. The uncoupling lever of claim 22 wherein the travel stop is removably connectable at the second lever member second axial end.

24. The uncoupling lever of claim 11 wherein the first lever member has a stop configured to limit compression of the second lever member relative to the first lever member.

25. The uncoupling lever of claim 11 further comprising rollers configured to rotatably engage the third lever member.

26. The uncoupling lever of claim 11 wherein the first lever member housing is disposed on an exterior surface of the first lever member.

27. The uncoupling lever of claim 11 wherein the first lever member housing comprises at least two enclosures spaced apart along a length of the first lever member.

* * * * *